US007571584B2

(12) United States Patent
Lerner et al.

(10) Patent No.: US 7,571,584 B2
(45) Date of Patent: Aug. 11, 2009

(54) WEB AND METHOD FOR MAKING FLUID FILLED UNITS

(75) Inventors: Bernard Lerner, Aurora, OH (US); Hershey Lerner, Aurora, OH (US); Rick S. Wehrmann, Hudson, OH (US); Dana J. Liebhart, Streetsboro, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 11/194,375

(22) Filed: Aug. 1, 2005

(65) Prior Publication Data

US 2006/0042191 A1 Mar. 2, 2006

(51) Int. Cl.
*B65D 81/03* (2006.01)

(52) U.S. Cl. ..... 53/79; 53/403; 156/147; 156/498

(58) Field of Classification Search ..... 53/79, 53/403, 562; 156/145, 147, 497, 498
See application file for complete search history.

(56) References Cited

U.S. PATENT DOCUMENTS 3,254,820 A 6/1966 Lerner
3,254,828 A 6/1966 Lerner
3,298,156 A 1/1967 Lerner
3,358,823 A 12/1967 Paxton
3,359,703 A 12/1967 Quaadgras
3,414,140 A 12/1968 Feldkamp
3,462,027 A 8/1969 Puckhaber
3,477,196 A 11/1969 Lerner
3,523,055 A 8/1970 Lemelson
3,575,757 A 4/1971 Smith (Continued)

FOREIGN PATENT DOCUMENTS

EP 1 466 720 A2 10/2004

(Continued)

OTHER PUBLICATIONS

International Search Report and Written Opinion from International Application No. PCT/US 2005/18817, dated Mar. 30, 2007, 6 pages.

(Continued)

*Primary Examiner*—Thanh K Truong
(74) *Attorney, Agent, or Firm*—Calfee, Halter & Griswold LLP

(57) ABSTRACT

The present invention concerns a machine for converting a web of preformed pouches to dunnage units. The pouches are defined by transverse seals that extend from a remote edge to within a predetermined distance of an inflation edge. In a first embodiment, the machine includes a guide pin, a drive, a blower, and a sealing element. The guide pin is insertable between the transverse seals and the inflation edge. The guide pin defines a path of travel of the web. The drive moves the web along the path of travel. The blower is positioned with respect to the path of travel for inflating the preformed pouches. The sealing element is positioned to provide a longitudinal seal that intersects the transverse seals to close the preformed pouches and form inflated dunnage units. The disclosed examples of machines for converting a web of preformed pouches to dunnage units including various improvements to existing machines.

9 Claims, 15 Drawing Sheets

U.S. PATENT DOCUMENTS 3,575,781 A 4/1971 Pezely
3,577,305 A 5/1971 Hines et al.
3,616,155 A 10/1971 Chavannes
3,650,877 A 3/1972 Johnson
3,730,240 A 5/1973 Presnick
3,791,573 A 2/1974 Titchenal et al.
3,802,974 A * 4/1974 Emmel ..... 156/55
3,808,981 A 5/1974 Shaw
3,817,803 A 6/1974 Horsley
3,837,990 A 9/1974 McConell et al.
3,837,991 A 9/1974 Evans
3,939,991 A 9/1974 Evans
3,855,037 A * 12/1974 Imhagen et al. ..... 156/497
3,938,298 A 2/1976 Luhman et al.
3,939,995 A 2/1976 Baxter
4,014,154 A 3/1977 Lerner
4,017,351 A 4/1977 Larson et al.
4,040,526 A 8/1977 Baxter et al.
4,044,693 A 8/1977 Ramsey, Jr.
4,076,872 A 2/1978 Lewicki et al.
4,096,306 A 6/1978 Larson
4,102,364 A 7/1978 Leslie et al.
4,103,471 A 8/1978 Lowdermilk
4,146,069 A 3/1979 Angarola et al.
4,169,002 A * 9/1979 Larson ..... 156/145
4,201,029 A 5/1980 Lerner
4,306,656 A 12/1981 Dahlem
4,314,865 A 2/1982 Ottaviano
4,354,004 A 10/1982 Hughes et al.
4,493,684 A 1/1985 Bolton
4,518,654 A 5/1985 Eichbauer et al.
4,545,180 A * 10/1985 Chung et al. ..... 53/456
4,564,407 A 1/1986 Tsuruta
4,576,669 A 3/1986 Caputo
4,597,244 A 7/1986 Pharo
4,616,472 A 10/1986 Owensby et al.
4,619,635 A 10/1986 Ottaviano
4,676,376 A 6/1987 Keiswetter
4,787,755 A 11/1988 Branson
4,793,123 A 12/1988 Pharo
4,847,126 A 7/1989 Yamashiro et al.
4,874,093 A 10/1989 Phara
4,904,092 A 2/1990 Campbell et al.
4,918,904 A 4/1990 Pharo
4,922,687 A 5/1990 Chow et al.
4,931,033 A 6/1990 Leeds
5,070,675 A * 12/1991 Chuan-Shiang ..... 53/79
5,117,608 A 6/1992 Nease et al.
5,151,494 A 9/1992 Munday et al.
5,181,614 A 1/1993 Watts
5,188,691 A 2/1993 Caputo
5,203,761 A 4/1993 Reichental et al.
5,216,868 A 6/1993 Cooper et al.
5,257,492 A 11/1993 Watts
5,272,856 A 12/1993 Pharo
5,289,671 A 3/1994 Lerner
5,307,969 A 5/1994 Menendez
5,340,632 A * 8/1994 Chappuis ..... 428/71
5,351,828 A 10/1994 Becker et al.
5,383,837 A 1/1995 Watts
5,394,676 A 3/1995 Lerner
5,468,525 A 11/1995 Watts
5,470,300 A 11/1995 Terranova
5,552,003 A 9/1996 Hoover et al.
5,693,163 A 12/1997 Hoover et al.
5,699,653 A * 12/1997 Hartman et al. ..... 53/455
5,733,045 A * 3/1998 Jostler et al. ..... 383/37
5,810,200 A 9/1998 Trokhan
5,921,390 A 7/1999 Simhaee
RE36,501 E 1/2000 Hoover et al.
6,015,047 A * 1/2000 Greenland ..... 206/522
6,015,357 A 1/2000 Rizza
RE36,759 E 7/2000 Hoover et al.
6,199,349 B1 3/2001 Lerner
6,209,286 B1 4/2001 Perkins et al.
6,488,222 B1 12/2002 West et al.
6,519,916 B1 2/2003 Brown
6,527,147 B2 3/2003 Wehrmann
6,550,229 B2 4/2003 Sperry et al.
6,565,946 B2 * 5/2003 Perkins et al. ..... 428/166
6,582,800 B2 6/2003 Fuss et al.
6,625,956 B1 * 9/2003 Soudan ..... 53/455
6,635,145 B2 * 10/2003 Cooper ..... 156/441.5
6,659,150 B1 12/2003 Perkins et al.
6,672,037 B2 1/2004 Wehrmann
6,751,926 B1 * 6/2004 Cooper ..... 53/79
6,786,022 B2 * 9/2004 Fuss et al. ..... 53/403
6,952,910 B1 10/2005 Lorsch
6,955,846 B2 10/2005 Lerner
7,165,375 B2 * 1/2007 O'Dowd ..... 53/96
2002/0108697 A1 * 8/2002 Perkins et al. ..... 156/145
2005/0266189 A1 12/2005 Wehrmann
2006/0086064 A1 4/2006 Wehrmann
2006/0090421 A1 * 5/2006 Sperry et al. ..... 53/403
2007/0054074 A1 3/2007 Wehrmann
2007/0054075 A1 3/2007 Wehrmann

FOREIGN PATENT DOCUMENTS

WO WO 00/71423 A1 11/2000
WO WO 01/85434 A2 11/2001
WO WO 02/26589 A1 4/2004
WO 2005/118408 12/2005
WO 2007/070240 6/2007

OTHER PUBLICATIONS

USPTO Non-Final Office Action having a mailing date of Mar. 19, 2008 in co-pending U.S. Appl. No. 11/299,933, filed Dec. 12, 2005.
Office action from U.S. Appl. No. 11/141,304, notification date Nov. 7, 2008.
Office action from U.S. Appl. No. 11/299,933, mailed Sep. 16, 2008.
Response from U.S. Appl. No. 11/299,933 dated Jun. 3, 2008.
Response from U.S. Appl. No. 11/299,933 dated Nov. 17, 2003.
Office action from U.S. Appl. No. 11/299,933 dated Dec. 18, 2008.
International Search Report and Written Opinion from International Application No. PCT/US 2006/045447, dated Feb. 22, 2007, 10 pages.
International Search Report and Written Opinion from PCT/US08/81410 dated Mar. 31, 2009.
Office action from U.S. Appl. No. 11/141,304 dated Apr. 28, 2009.

* cited by examiner

WEB AND METHOD FOR MAKING FLUID FILLED UNITS

FIELD OF THE INVENTION

The present application relates to fluid filled units and more particularly to a machine for converting a web of preformed pouches to dunnage units.

BACKGROUND

Machines for forming and filling dunnage units from sheets of plastic are known. Machines which produce dunnage units by inflating preformed pouches in a preformed web are also known. For many applications, machines which utilize preformed webs are preferred.

SUMMARY

The present invention concerns a machine for converting a web of preformed pouches to dunnage units. The pouches are defined by transverse seals that extend from a remote edge to within a predetermined distance of an inflation edge. In a first embodiment, the machine includes a guide pin, a drive, a cutter, a blower, and a sealing element. The guide pin is insertable between the transverse seals and the inflation edge. The guide pin defines a path of travel of the web. The drive moves the web along the path of travel. The cutter is positioned with respect to the path of travel to cut the web to open the web for inflation. The blower is positioned with respect to the path of travel for inflating the preformed pouches. The sealing element is positioned to provide a longitudinal seal that intersects the transverse seals to close the preformed pouches and form inflated dunnage units.

In another embodiment, the cutter is positioned at an angle with respect to the web travel path to cut the web on one side of the inflation edge.

In another embodiment, a line of perforations run along the inflation edge of the preformed pouches and the cutter is replaced by a blunt surface. The blunt surface is positioned with respect to the inflation edge to open the web for inflation.

Another embodiment of the invention involves positioning an elongated sealing element at an angle with respect to the path of travel. This provides for a wider, stronger seal. In one embodiment, the elongated sealing element is oriented at approximately 1.5 degrees with respect to the path of travel.

In another embodiment of the invention a cooling element is positioned to cool the seal formed by the sealing element.

A method for converting a web of preformed pouches to dunnage units comprises moving the web along a path of travel; cutting the web on one side of the inflation edge to thereby open the web for inflation; inflating the preformed pouches; and sealing the web across the transverse seals to close the preformed pouches and form inflated dunnage units.

In another embodiment of the invention the machine may selectively operate in an idle mode or in a production mode. The machine functions differently in idle mode than production mode to minimize the amount of waste generated in producing dunnage units.

DETAILED DESCRIPTION

FIGS. 1 through 6 illustrate examples of preformed webs 10 that can be processed by a dunnage inflation machine 50. Examples of dunnage inflation machines are illustrated by FIGS. 7A, 7B, 8A, 8B, and 10 through 17. It should be readily apparent that other preformed webs could be used in the machine 50 to produce dunnage units. U.S. patent application Ser. No. 11/141,304, entitled "Web and Method for Making Fluid Filled Units," filed on May 31, 2005 and U.S. Provisional Patent Application Ser. No. 60/592,812, filed on Jul. 30, 2004, are incorporated herein by reference in their entirety.

Figure 1:
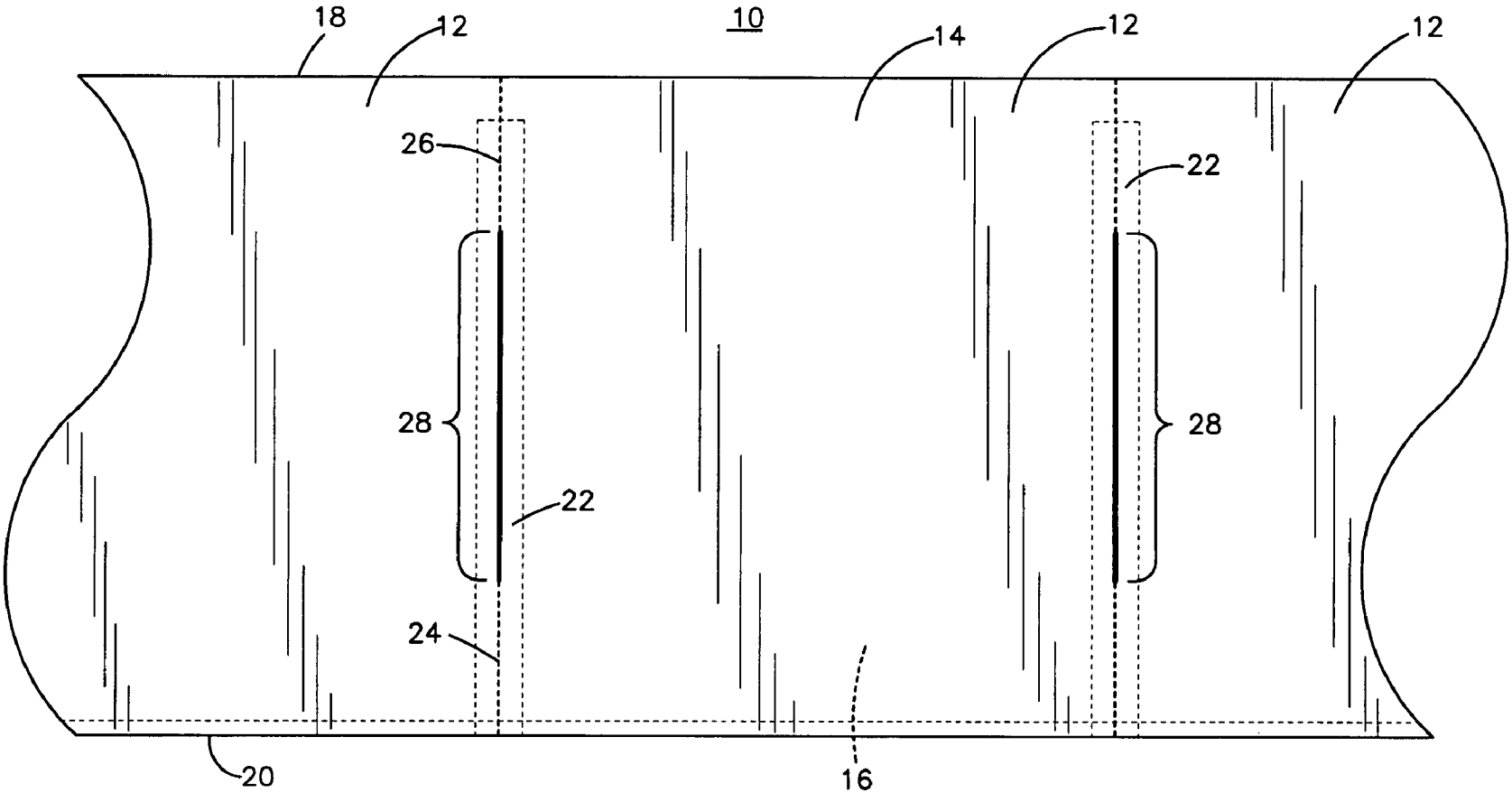
FIG. 1 illustrates a web for making fluid filled units.
Figure 2:
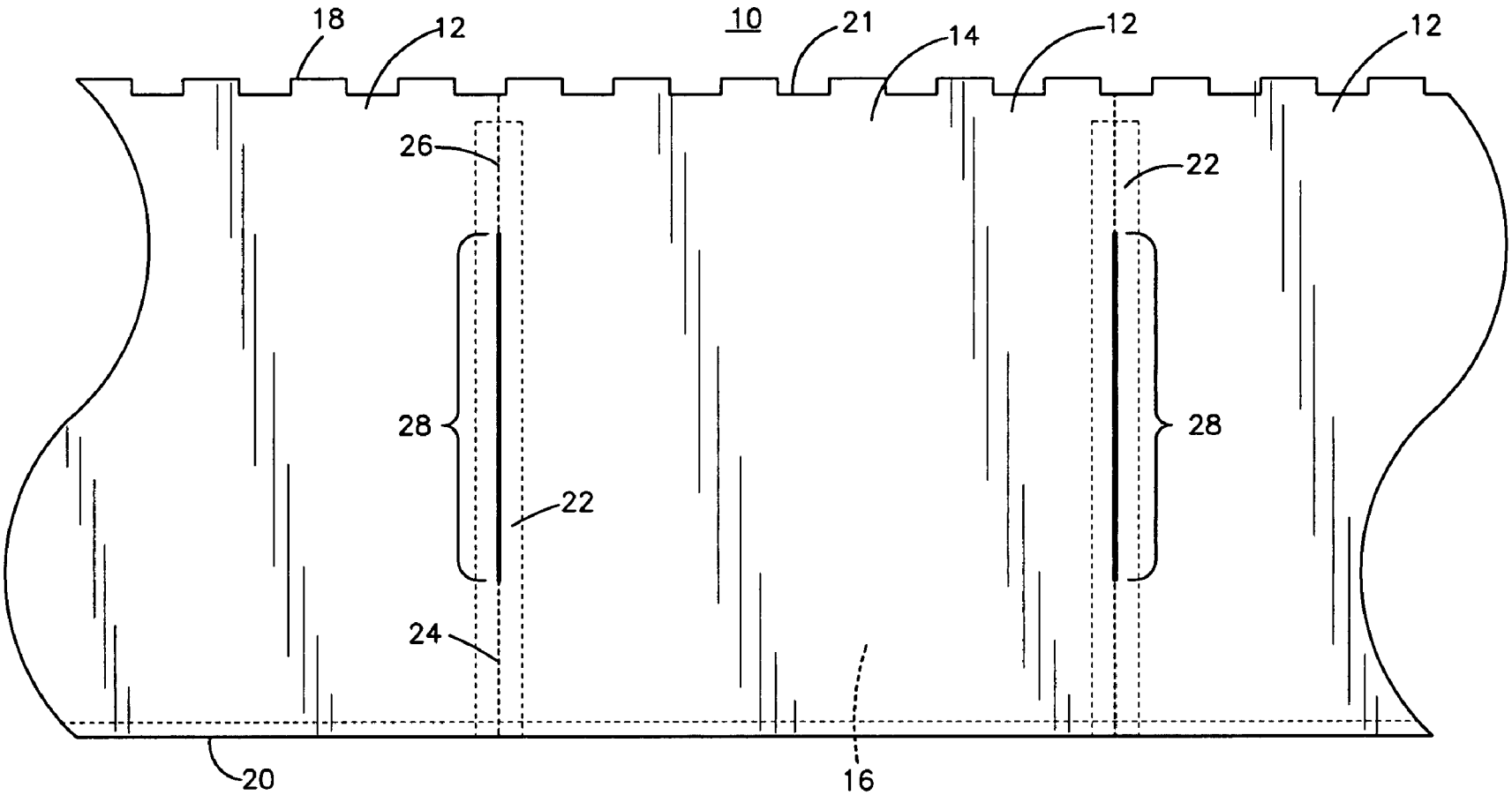
FIG. 2 illustrates a web for making fluid filled units.

Referring to FIGS. 1 and 2, exemplary illustrations of webs 10 of inflatable pouches 12 are shown. The webs 10 includes a top elongated layer of plastic 14 superposed onto a bottom layer of plastic 16. The layers are connected together along spaced edges, referred to as the inflation edge 18 and the opposite edge 20. In the examples illustrated by FIG. 1 through 6, each edge 18, 20 is either a fold or a seal that connects the superposed layers 14, 16 along the edges 18, 20. The connection at the opposite edge 20 is illustrated as a hermetic seal and the connection at the inflation edge 18 is illustrated as a fold in FIG. 1. However, the fold and the seal could be reversed or both of the connections could be seals in the embodiments. In the example illustrated by FIG. 2, the inflation edge 18 comprises a frangible connection 21 and the opposite edge 20 is a hermetic seal. The illustrated frangible connection 21 is a line of perforations. The size of the perforations is exaggerated in FIG. 2 for clarity. The frangible connection 21 may be formed by folding the inflation edge 18 and pulling the inflation edge 18 over a serration forming wheel (not shown).

Referring to FIGS. 1 and 2, a plurality of longitudinally spaced, transverse seals 22 join the top and bottom layers 14, 16. Generally, each transverse seal 22 extends from the opposite edge 20 to within a short distance of the inflation edge 18. Spaced pairs of lines of perforations 24, 26 extend through the top and bottom layers terminating a short distance from the edges 18, 20 respectively. A gap forming area 28 extends between each associated pair of lines of perforations 24, 26. The gap forming area 28 opens to form a gap 13 when the pouches are inflated (see FIG. 3).

A gap forming area 28 denotes an area, preferably linear in shape, that will rupture or otherwise separate when exposed to a predetermined inflation force. The magnitude of the inflation force is less than the magnitude of the force needed to rupture or separate the spaced apart lines of perforations 24, 26. The gap forming area 28 can take on a number of embodiments, as will be discussed below. Any method that produces an area between the spaced apart lines of perforations 24, 26 that ruptures or otherwise separates at a force lower than a force needed to rupture or separate spaced lines of perforations 24, 26 may be employed to make the gap forming area 28.

Figure 3:
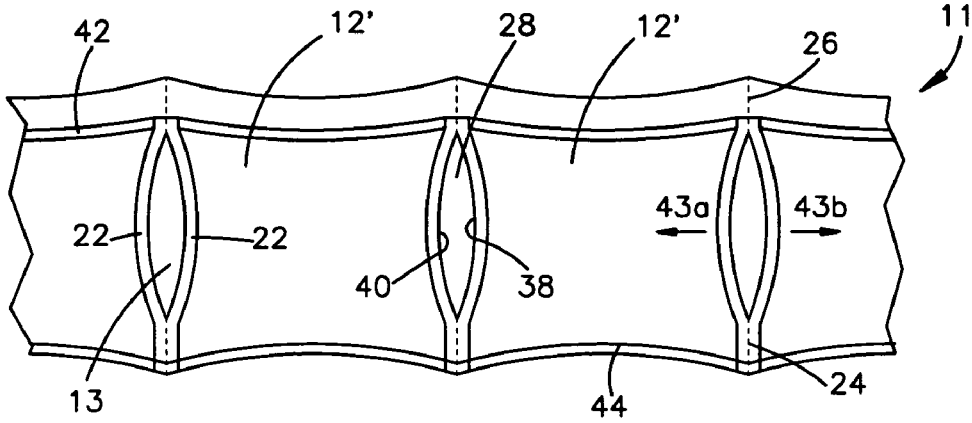
FIG. 3 illustrates a web with pouches inflated and sealed to form fluid filled units.

Referring to FIG. 3, the web 10 of pouches 12 (FIGS. 1 and 2) is inflated and sealed to form a row 11 of dunnage units 12'. The formed dunnage units 12' are configured to be much easier to separate from one another than prior art arrays of dunnage units. In the exemplary embodiment of FIG. 3, each adjacent pair of dunnage units 12' is connected together by a pair of spaced apart lines of perforations 24, 26. The spaced apart lines of perforations 24, 26 are spaced apart by a gap 13. A single row 11 of dunnage units 12' can be graphically described as being in a "ladder" configuration. This configuration makes separating two adjacent dunnage units 12' much easier than separating prior art arrays of dunnage units. To separate a pair of adjacent dunnage units 12, a worker simply inserts an object or objects, such as a hand or hands, into the gap 13 and pulls one dunnage unit 12' away from the other dunnage unit 12'. In the alternative, a mechanical system can be used to separate dunnage units 12'. A machine can be configured to insert an object between adjacent dunnage units 12' and apply a force to separate the units Referring to FIGS. 1-3, prior to conversion to a dunnage unit, a pouch 12 is typically hermetically sealed on three sides, leaving one side open to allow for inflation. Once the pouch 12 is inflated, the inflation opening is hermetically sealed and the dunnage unit is formed. During the inflation process, as the volume of the pouch 12 increases the sides of the pouch 12 have a tendency to draw inward. Drawing the sides of the pouches 12 inward will shorten the length of the sides of the pouch 12 unless the sides of the pouch 12 are constrained. In this application, the term foreshortening refers to the tendency of the length of a pouch side to shorten as the pouch 12 is inflated. In prior art webs, the sides of the pouch 12 are restrained, because sides of adjacent pouches are connected by lines of perforations that extend along the entire length of the pouches and remain intact during and after inflation. The foreshortening of the unrestrained sides, such as the inflation opening, may not be uniform. Restraining the sides of adjacent connected pouches can cause undesirable inflation induced stresses. These undesirable stresses are caused because sides of adjacent pouches are connected and restrained, thus, limiting inflation and causing wrinkles to develop in the layers at the unrestrained inflation opening. The wrinkles can extend into a section of the inflation opening to be sealed to complete the dunnage unit, which may comprise the seal. One reason the seal can be compromised is that wrinkling can cause sections of the layers 14, 16 to fold on top of one another. A sealing station of a dunnage machine is typically set to apply the appropriate amount of heat to seal two layers of material. The sealing of multiple layers of material in the area of a wrinkle results in a seal that is weaker than remaining seal areas and may result in a small leak or tendency to rupture at loads lower than loads at which the dunnage units is designed to rupture.

In the embodiment illustrated by FIG. 3, the gap forming area 28, produces a gap 13 between adjacent pouches upon inflation. The gap allows foreshortening of the pouch sides during inflation and thereby reduces the undesirable stresses that are introduced during inflation as compared with prior art webs. In addition, the web with a gap 13 facilitates fuller inflation of each pouch. The gap 13 maintains the inflation opening substantially free of wrinkles as the inflation opening is sealed to convert inflated pouches to dunnage units.

The illustrated web 10 is constructed from a heat sealable plastic film, such as polyethylene. The web 10 is designed to accommodate a process for inflating each pouch 12 in the web to create a row or ladder 11 of dunnage units 12'. The gap forming area 28 creates a gap 13 between dunnage units 12', which facilitate a efficient and effective process for separating adjacent dunnage units 12' in the row or ladder 11.

Figure 4:
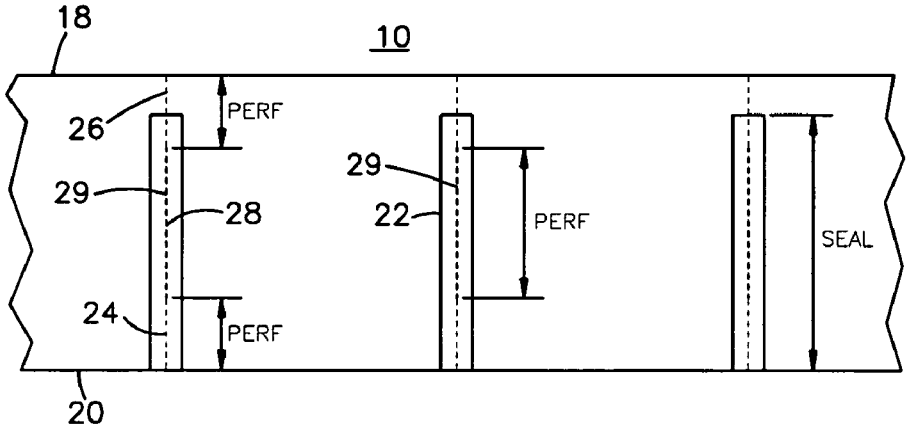
FIG. 4 illustrates a web for making fluid filled units.

In the example illustrated by FIG. 4, the gap forming area 28 defined by the web 10 includes an easily breakable line of perforations 29 between the spaced lines of perforations 24, 26. The force needed to rupture or separate the line of perforations 29 is less than the force needed to separate the perforations 24, 26 extending inward of the web edges 18, 20. Each pair of perforations 24, 26 and associated more easily breakable line of perforations 29 divide the transverse seal 22 into two transverse sections. As a pouch 12 is inflated, the line of perforation 29 begins to rupture or separate leading to the development of a gap 13 between the produced dunnage units 12' (See FIG. 3). Once the pouch 12 is fully inflated, the line of perforations 29 is fully or nearly fully ruptured; however the perforations 24, 26 at the edges remain intact. These perforations 24, 26 are ruptured or separated when a worker or automated process mechanically separates the perforations 24, 26.

Figure 5:
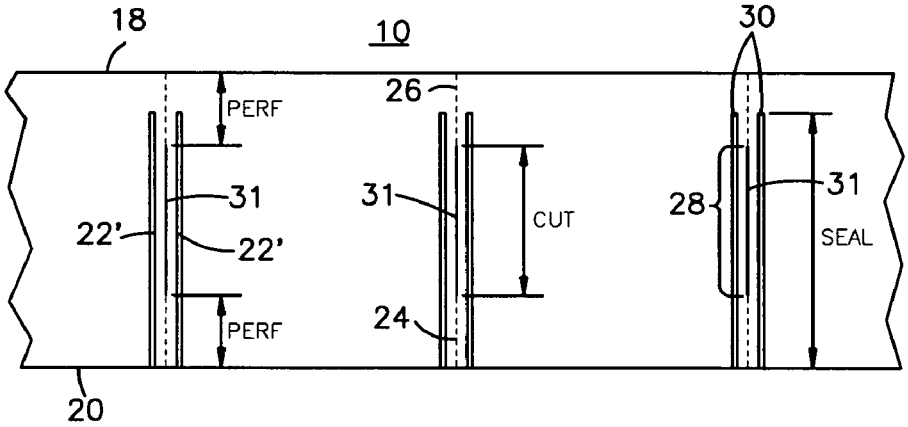
FIG. 5 illustrates a web for making fluid filled units.

FIG. 5 illustrates another embodiment of the web 10. In this embodiment the gap forming area 28 comprises an elongated cut 31 through both layers of material 14, 16. The cut 31 extends between each associated pair of lines of perforations 24, 26. In the embodiment illustrated by FIG. 5, pairs 30 of transverse seals 22' extend from the opposite edge 20 to within a short distance of the inflation edge 18. Each of the pairs of lines of perforations 24, 26 and corresponding cuts 31 are between an associated pair of transverse seals 30. It should be readily apparent that the seal 22 shown in FIG. 4 could be used with the cut 31 shown in FIG. 5. It should also be readily apparent that the line of perforations shown in FIG. 4 could be used with the transverse seals 22' shown in FIG. 5. It should be additionally apparent that any gap forming area 28 can be used with either of the transverse seal configurations 22, 22' shown in FIGS. 4 and 5.

Figure 6:
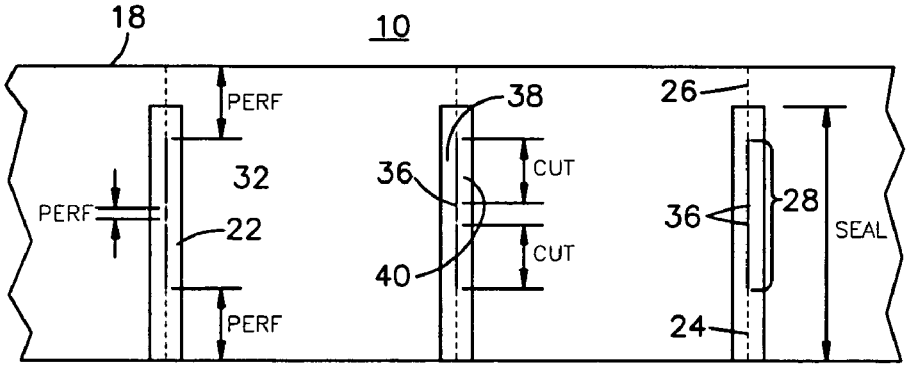
FIG. 6 illustrates a web for making fluid filled units.
Figure 7A:
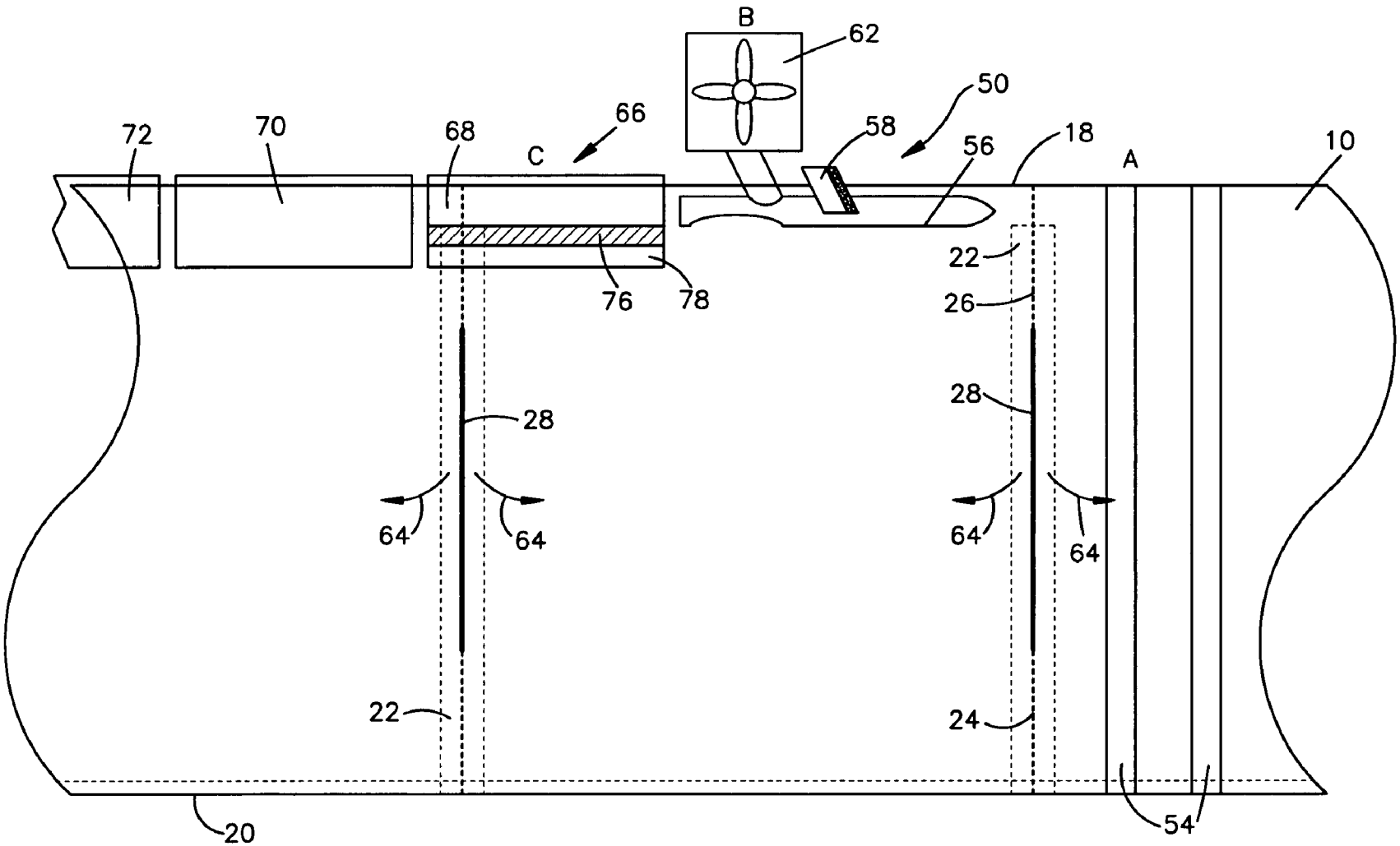
FIG. 7A schematically illustrates a plan view of a machine for converting web pouches to fluid filled units.
Figure 7B:
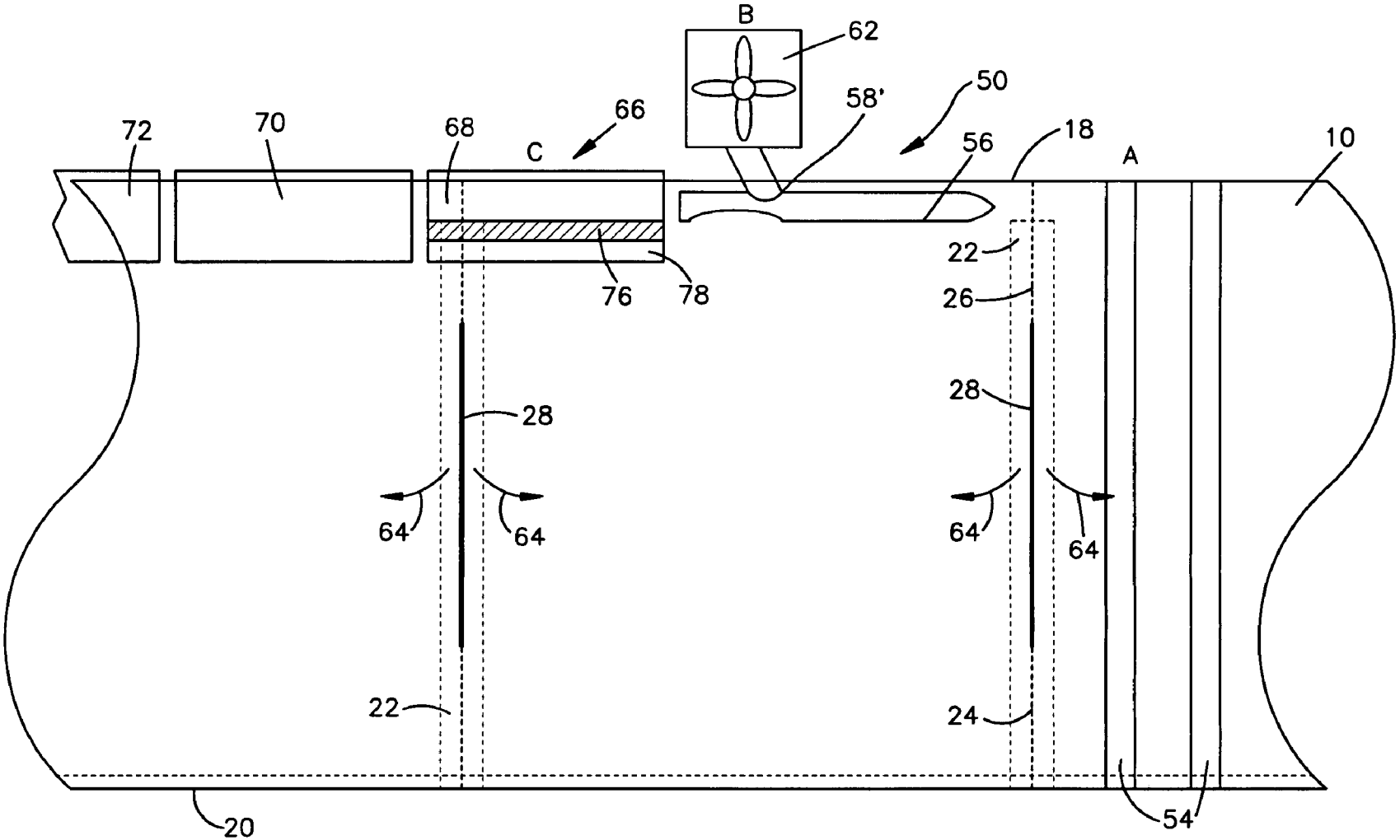
FIG. 7B schematically illustrates a plan view of a machine for converting web pouches to fluid filled units.

FIG. 6 illustrates a further embodiment of the web 10. In this embodiment, the gap forming area 28 comprises at least two elongated cuts 32, separated by light connections of plastic 36, also referred to as "ticks." These connections 36 hold transverse edges 38, 40 of the pouches 12 together to ease handling of the web 10, such as handling required during installation of the web 10 into a dunnage machine. As the pouches 12 are inflated, the connections 36 rupture or otherwise break resulting in a gap 13 between the spaced pairs of perforations 24, 26. This gap 13 allows for full inflation and reduces the stresses in the layers at the seal site normally caused by the foreshortening and restrictions on foreshortening of webs in the prior art. The reduced stress in the layers inhibits wrinkles along the inflation opening to be sealed.

Other methods of creating a gap forming area not specifically disclosed are with the scope of the present application. Any area that separates and forms a gap between adjacent pouches as pouches 12 in a web 10 are inflated are contemplated by this disclosure.

FIG. 3, illustrates a length of the web 10 after it has been inflated and sealed to form dunnage units 12'. An inflation seal 42, the transverse seals 22 and an opposite edge seal 44 hermetically seal the top and bottom layers. The side edges 38, 40 of the formed dunnage units are separated to form a gap 13. Each pair of adjacent dunnage units 12' are connected together by the pair of spaced apart lines of perforations 24, 26. The gap 13 extends between the pair of spaced apart lines of perforations 24, 26. The array of dunnage units 12' is a single row of dunnage units in a "ladder" configuration. The lines of perforations 24, 26 are configured to be easily breakable by a worker or automated system. To separate a pair of adjacent units 12', a worker inserts an object, such as the worker's hand or hands into the gap 13. The worker then grasps one or both of the adjacent dunnage units 12' and pulls the adjacent dunnage units 12' relatively apart as indicated by arrows 43*a*, 43*b*. The lines of perforation 24, 26 rupture or otherwise separate and the two adjacent dunnage units 12' are separated. The existence of the gap 13 also results in reduced stresses in the area of the inflation seal 42 at the time of sealing and accommodates increased inflation volume of the dunnage units 12' as compared with prior inflated dunnage units.

In one embodiment, the line of perforations 24 that extends from the opposite edge 20 is omitted. In this embodiment, the gap forming area 28 extends from the inflation edge line of perforations 26 to the opposite edge. In this embodiment, the gap 13 extends from the inflation edge line of perforations 26 to the opposite edge 20.

The connection of the layers 14, 16 at the inflation edge 18 can be any connection that is maintained between layers 14, 16 prior to the web 10 being processed to create dunnage units 12'. In the embodiment illustrated by FIG. 1, the connection is a fold. In the embodiment illustrated by FIG. 2, the connection is a line of perforations 21. One method of producing such a web is to fold a continuous layer of plastic onto itself and create a fold at what is to become the inflation edge 18, A tool can be placed in contact with the fold to create a line of perforation. The opposite edge 20 can be hermetically sealed and the transverse hermetic seals 22 can be added along with the separated lines of perforations 24, 26 extending inward from the inflation and opposite edges 18, 20. The web shown in FIG. 1 can be produced in the same manner, except the perforations are not added.

Figure 8A:
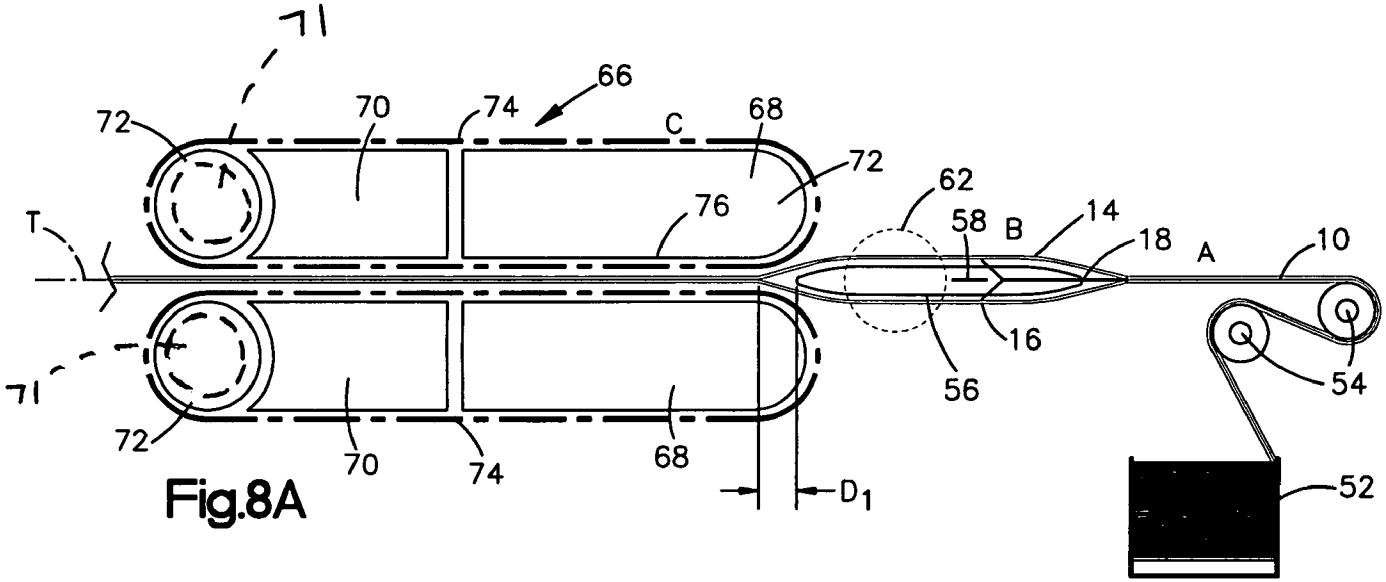
FIG. 8A schematically illustrates an elevational view of a machine for converting web pouches to fluid filled units.
Figure 8B:
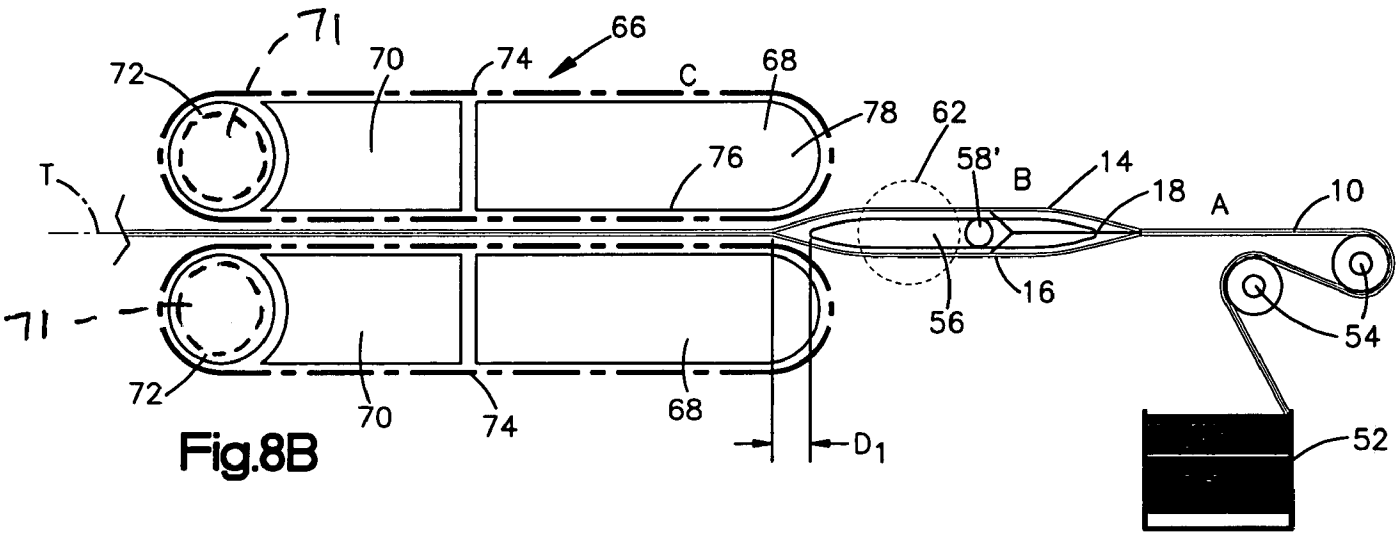
FIG. 8B schematically illustrates an elevational view of the machine for converting web pouches to fluid filled units.

FIGS. 7A, 7B, 8A, 8B and 9 schematically illustrate a machine 50 and processes of converting the webs 10 to dunnage units 12'. Referring to FIGS. 8A and 8B, a web 10 is routed from a supply 52 to and around a pair of elongated, transversely extending guide rollers 54. The guide rollers 54 keep the web 10 taught as the web 10 is pulled through the machine 50. At location A, the web pouches are uninflated. In the embodiment illustrated by FIG. 5, pouch edges 38, 40 defined by the cut 31 are close to one another at location A. In the embodiments illustrated by FIGS. 4 and 6, the frangible connections 29, 36 are of sufficient strength to remain intact at location A.

A longitudinally extending guide pin 56 is disposed in the web at station B. The guide pin 56 is disposed in a pocket bounded by the top and bottom layers 14, 16, the inflation edge 18, and ends of the transverse seals 22. The guide pin 56 aligns the web as it is pulled through the machine. In the embodiment illustrated by FIGS. 7A and 8A, a knife cutter 58 extends from the guide pin 56. The knife cutter 58 is used to cut the inflation edge 18 illustrated by FIG. 1, but could also be used to cut the perforated inflation edge 18 illustrated by FIG. 2. The cutter 58 slits the inflation edge 18 as the web moves through the machine 50 to provide inflation openings 59 (See FIG. 9) into the pouches, while leaving the pouches otherwise imperforate. A variation of this would have the cutter 58 cutting either layer 14, 16, or both near the inflation edge 18. In the embodiment illustrated by FIGS. 7B and 8B, a blunt surface 58' extends from the guide pin and the knife cutter is omitted. The blunt surface 58' is used to break the perforated inflation edge 18 illustrated by FIG. 2. The blunt surface 58' breaks open the inflation edge 18 as the web moves through the machine to provide the inflation openings into the pouches 12.

Figure 10:
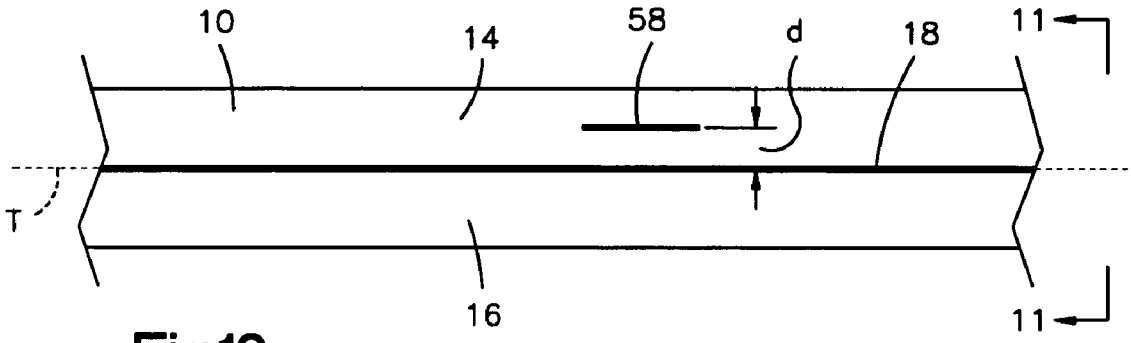
FIG. 10 schematically illustrates a cutter offset from an edge of a web of preformed pouches.
Figure 11:
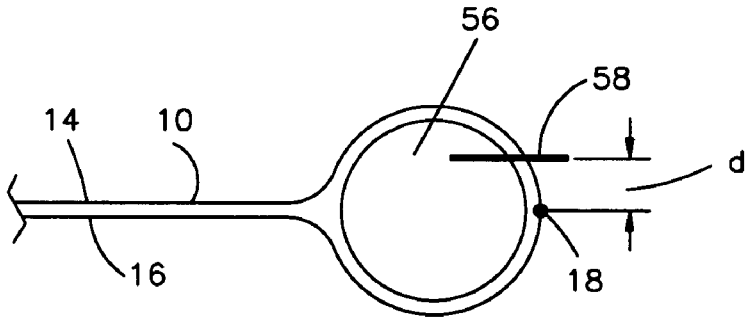
FIG. 11 is a schematically illustrates a cutter offset from an edge of a web of preformed pouches.
Figure 12:
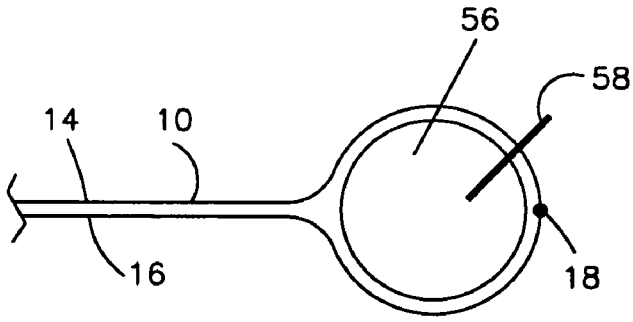
FIG. 12 is schematically illustrates a cutter positioned at an angle with respect to an edge of a web of preformed pouches.

In the embodiment illustrated by FIGS. 10 through 14, the cutter 58 is positioned with respect to the path of travel T to cut the web 10 on one side of the inflation edge 18. Offsetting the cutter 58 prevents the inflation edge from moving back and forth from one side of the cutter 58 to the other and creating a "zigzag" cut line. FIG. 10 is a head on view of a cutter 58 extending through the web 10. The cutter 58 is offset from the intended path of travel T of the inflation edge 18 a distance d. FIG. 11 is a side view of the cutter 58 offset from the inflation edge by distance d. FIG. 12 illustrates an embodiment where the cutter 58 is positioned at an angle with respect to the web travel path to cut the web on one side of the inflation edge 18.

Figure 13:
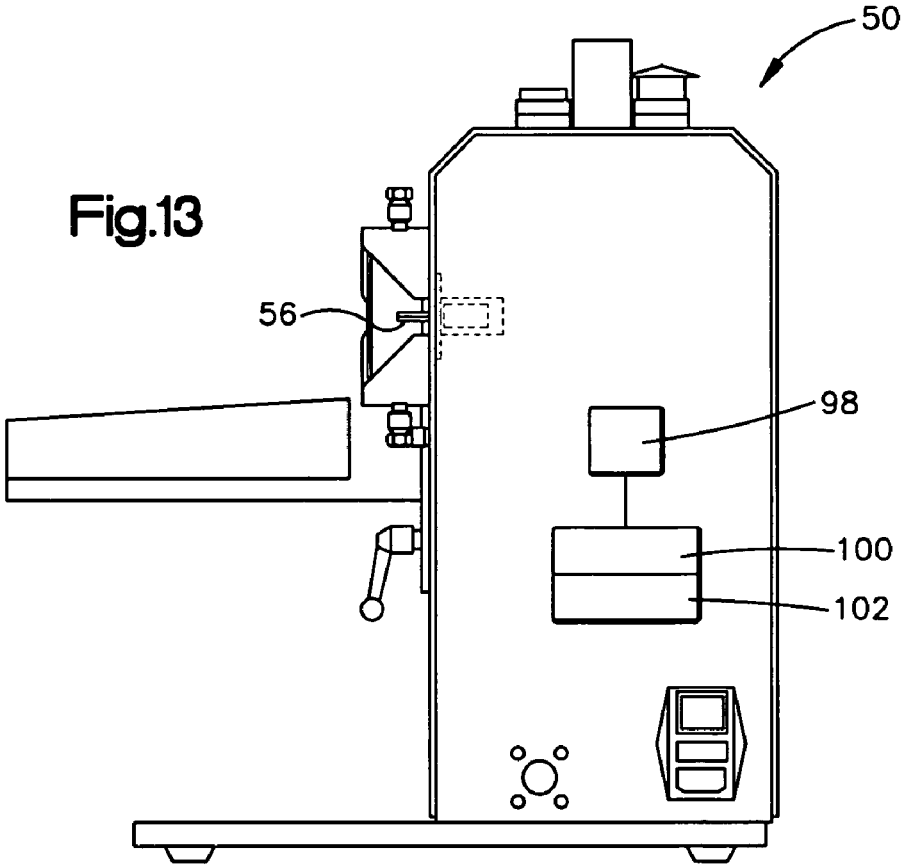
FIG. 13 is an elevational view of an air pouch machine.
Figure 14:
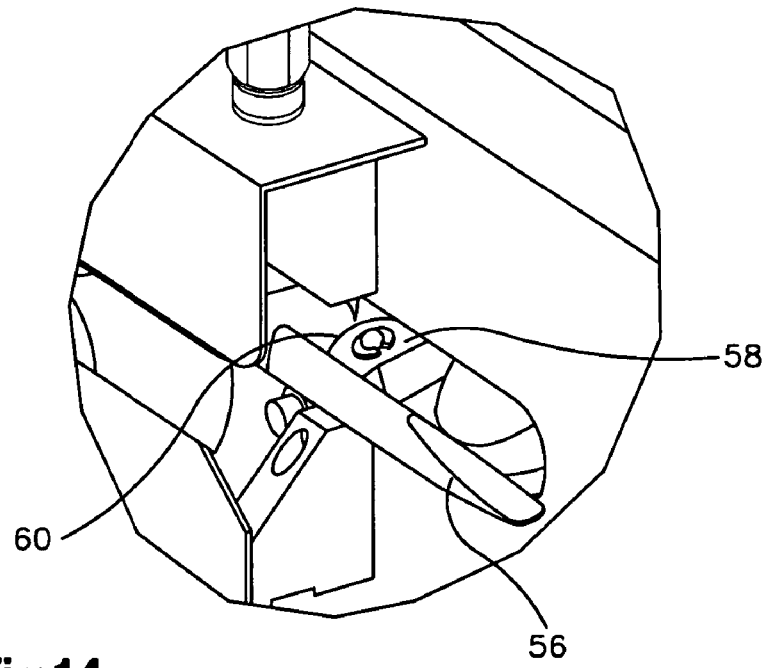
FIG. 14 is a perspective view of a cutter positioned at an angle and offset with respect to a web path of travel.

In the example illustrated by FIGS. 13 and 14, the cutter 58 is a with a sharp circumferential edge 60. The cutter illustrated in FIGS. 13 and 14 is both offset and positioned at an angle with respect to path of the inflation edge 18. The disk is rotationally fixed in one embodiment. When the portion of the edge 60 that engages the web 10 becomes dull, the illustrated cutter can be temporarily loosened and rotated to provide another sharp portion of the edge 60 to engage the web 10, and then the disk 58' can be retightened.

Figure 18:
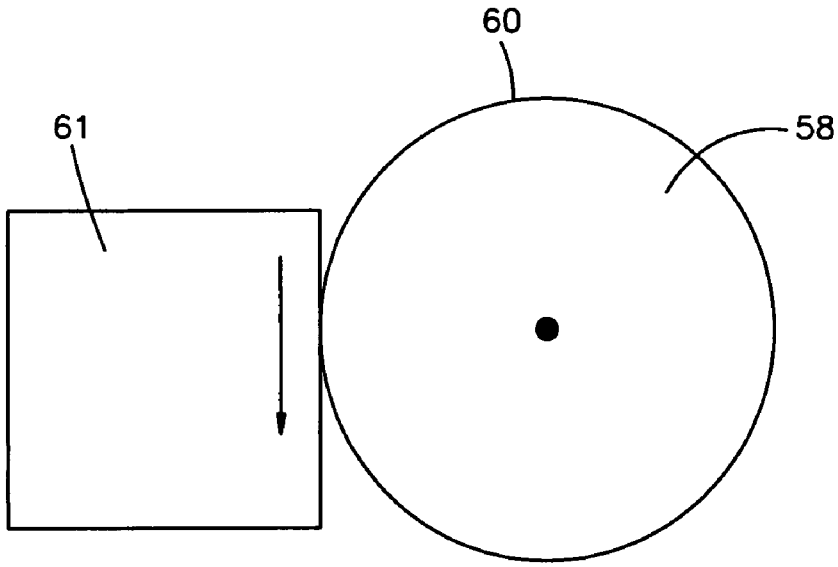
FIG. 18 is a schematic view of a web cutting unit.

Optionally the movement of the cutter 58 to provide a sharp portion of the cutting edge to the web can be automated. As illustrated in FIG. 18, a rotation mechanism 61 may be used to slowly or periodically rotate a disk cutter 58 so that a new and sharp portion of the cutting edge 60 is moved into position to contact and cut the web 10 as the current cutting edge dulls. The rotation mechanism 61 can be a gear or spring mechanism, or any other mechanisms that advances the edge of the cutter 58. An automatically advancing cutter is not limited to a disk shape. In one embodiment a linear cutting surface, for example, is automatically advanced to offer a new and sharp cutting surface to the web 10 as the current surface dulls.

Figure 9:
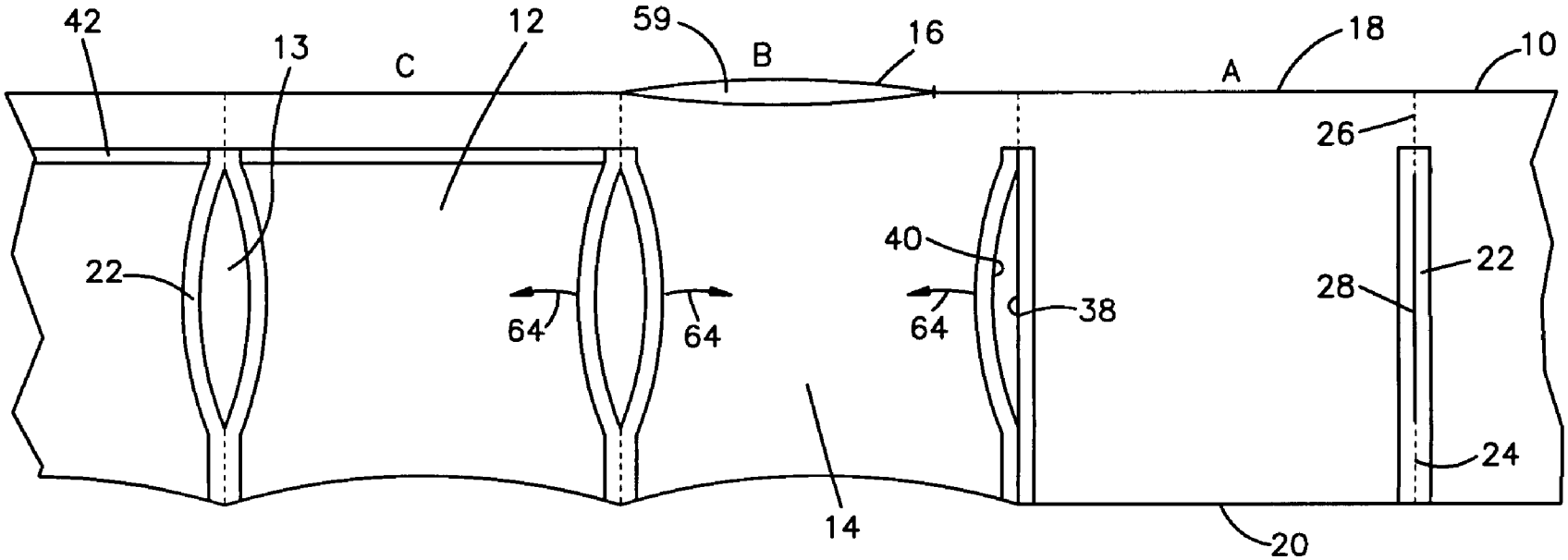
FIG. 9 illustrates a process for converting web pouches to fluid filled units.

A blower 62 is positioned after the cutter 58 or blunt surface 58' at station B. The blower 62 inflates the web pouches as the web 10 moves past the blower 62. Referring to FIG. 9, the web pouches are opened and inflated at station B. The seal edges 38, 40 spread apart as indicated by arrows 64 (FIGS. 7A, 7B and 9) as the web pouches are inflated. In the embodiment illustrated by FIGS. 4 and 6, the frangible connections 29, 36 maintain successive pouches substantially aligned as the web 10 is fed to the filling station B. The frangible connections are sufficiently weak that the connection between a pouch that has been opened for inflation and is being inflated at the fill station B and an adjacent, successive (or preceding) pouch will rupture as the pouch at the fill station is inflated. The spreading of the edges 38, 40 forms a row of inflated dunnage units in a ladder configuration and increases the volume of the air that can enter the pouches. The spreading also reduces the stresses imparted to the web 10 adjacent the inflation side edge 18 where it is to be sealed. The reduction in stress reduces the chance that the web 10 will wrinkle in this area.

The inflation seal 42 is formed at station C by a sealing assembly 66 to complete each dunnage unit. In the exemplary embodiment, the inflated volume of the pouches is maintained by continuing to blow air into the pouch until substantially the entire length of the inflation opening 59 is sealed. In the example of FIGS. 8A, 8B and 9, the blower 62 blows air into a pouch being sealed up to a location that is a short distance $D_1$ from closing position where the sealing assembly 66 pinches the top and bottom layers 14, 16 to maintain the inflated volume of the pouches. This distance $D_1$ is minimized to minimize the volume of air that escapes from the inflated pouch before the trailing transverse seal of the inflated pouch reaches the closing position. For example, the distance $D_1$ may be 0.250 inches or less, to blow air into the inflation opening unit the trailing transverse seal is within 0.250 inches of the closing position.

In the examples illustrated by FIGS. 8A and 8B, the sealing assembly includes a pair of heated sealing elements 68, a pair of cooling elements 70, a pair of drive rollers 72, and a pair of drive belts 74. In an alternate embodiment, the pair of cooling elements is omitted. In the example illustrated by FIGS. 8A and 8B, two motors 71 are included to drive the drive rollers 72. One motor drives the upper drive roller and the second motor drives the lower drive roller. In this example, the motors 71 are DC motors that are wired in series. As a result, the motors will tend to rotate the drive rollers at approximately the same speed when the drive rollers are spaced apart. The drive rollers 72 and drive belts 74 form a drive that moves the web along a path of travel T. Each belt 74 is disposed around its respective heat sealing element 68, cooling element 70 (if included), and drive roller 72. Each belt 74 is driven by its respective drive roller 72. The belts 74 are in close proximity or engage one another, such that the belts 74 pull the web 10 through the heat sealing elements 68 and the cooling elements 70. When the belts 74 engage one another or engage the web, the motors 71 are coupled and turn the drive rollers at the same speed. The use of two motors 71 that separately drive the first and second drive rollers has advantages over the use of a single motor that drives both of the drive belts. For example, the drive rollers 72 do not have to be mechanically coupled by gears or belts and each motor can be smaller than a single motor that would be required to drive both belts.

The seal 42 is formed as the web 10 passes through first the heated sealing elements 68 and then the cooling elements 70. One suitable heating element 68 includes heating wire 76 carried by an insulating block 78. Resistance of the heating wire 76 causes the heating wire 76 to heat up when voltage is applied. The cooling elements 70 cool the seal 42 as the web 10 is pulled between the cooling elements 70. One suitable cooling element 70 is an aluminum (or other heatsink material) block that transfers heat away from the seal 42. Referring to FIG. 9, the spreading of the edges 38, 40 greatly reduces the stress imparted on the web material at or near the seal 42. As a result, a much more reliable seal 42 is formed.

Figure 15:
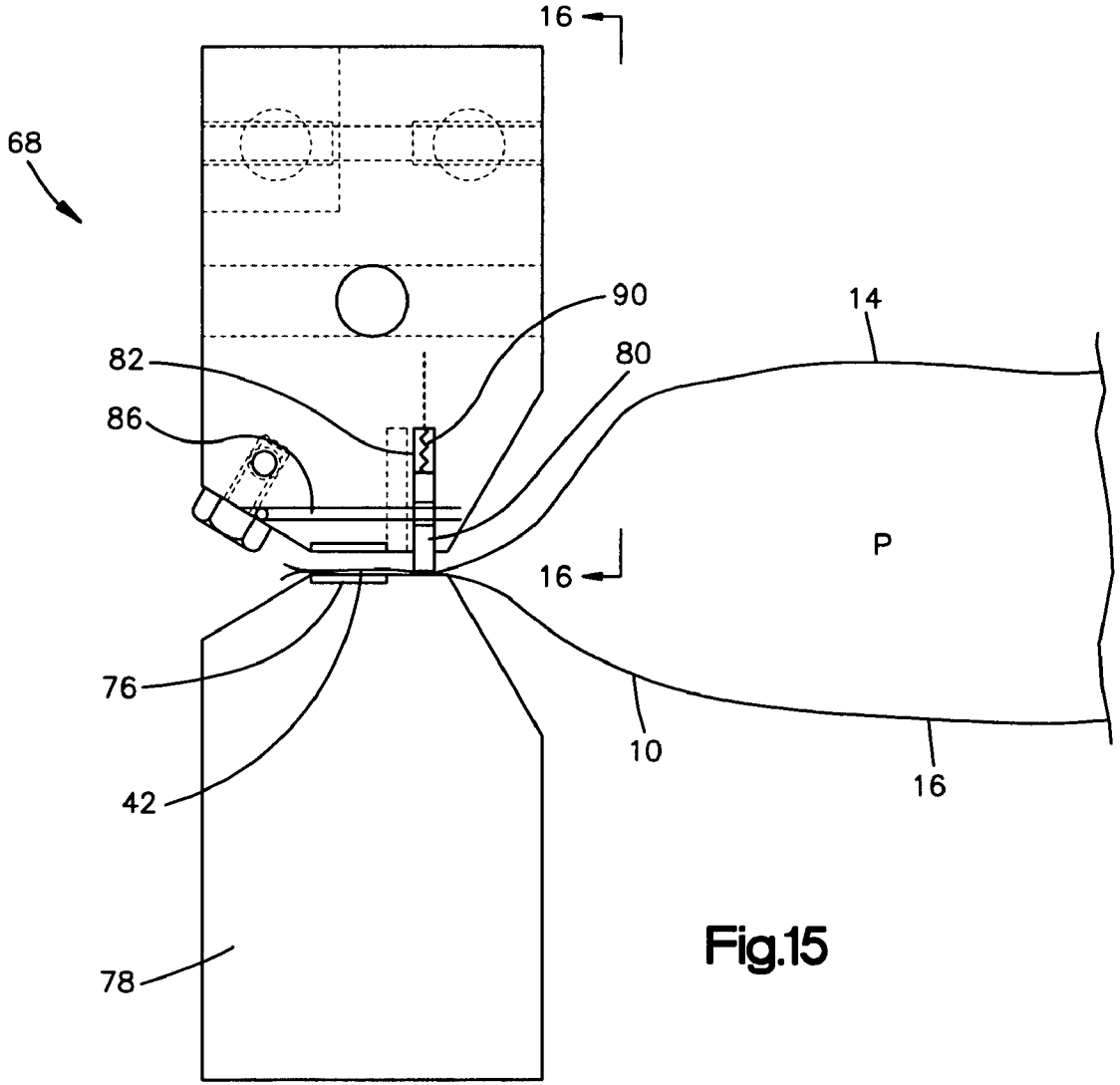
FIG. 15 is an elevational view of a sealing element sealing filled pouches.
Figure 16:
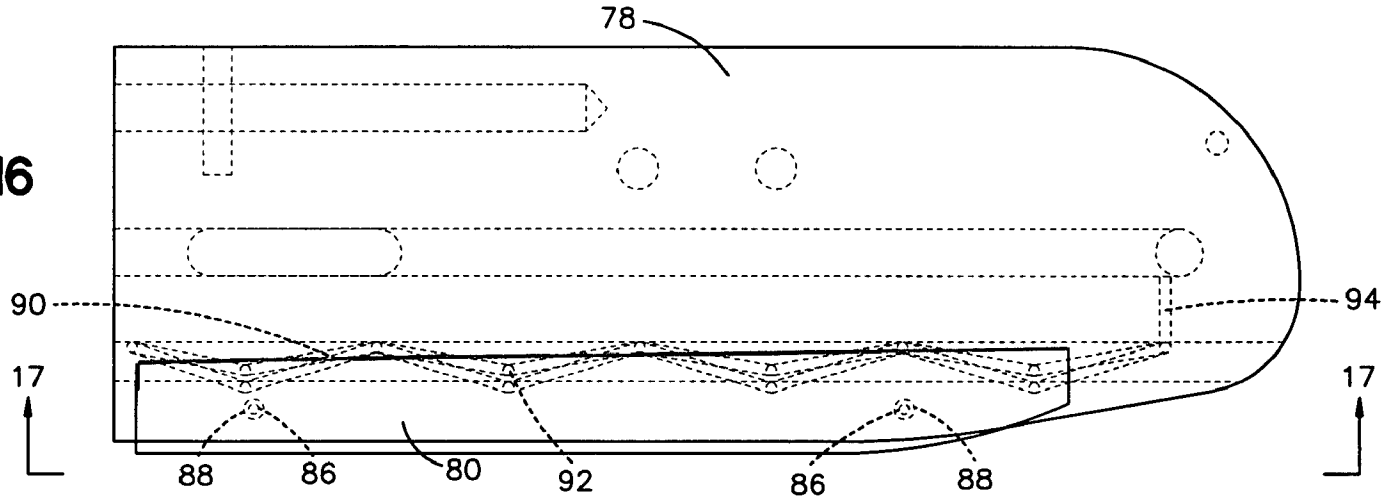
FIG. 16 is a view taken along the plane indicated by lines 16-16 in FIG. 15 with the web omitted.
Figure 17:
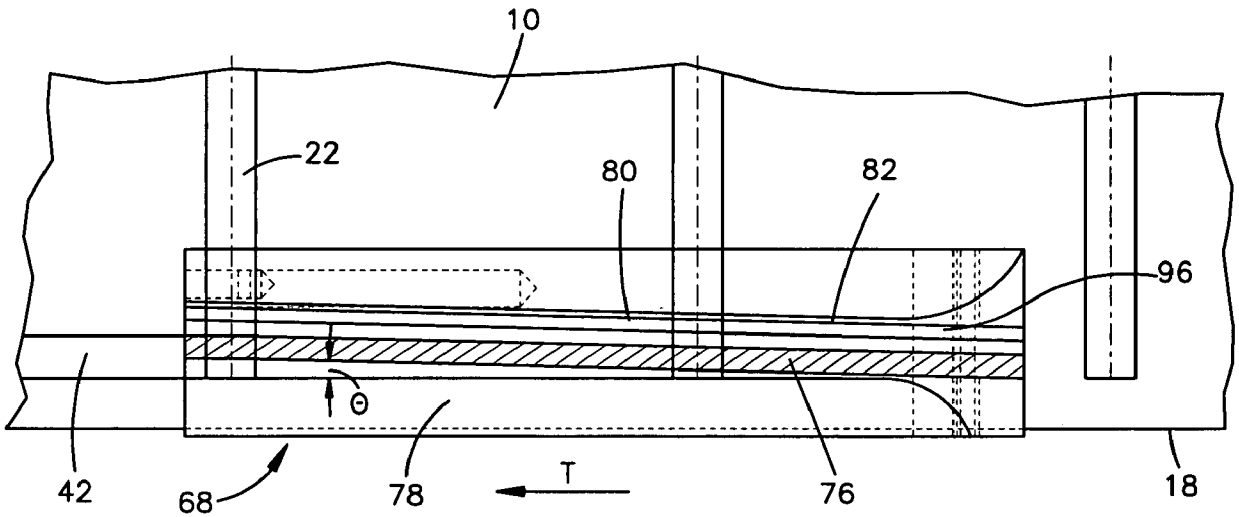
FIG. 17 is a view taken along the plane indicated by lines 17-17 in FIG. 16 with the web shown.

Referring to FIGS. 15-17, the machine 50 may include a pinching member 80 positioned to pinch the top and bottom layers 14, 16 of the preformed web together. The pinching member 80 inhibits air under pressure P (FIG. 15) in the inflated webs from applying force to the molten longitudinal seal 42. This prevents the air under pressure P from blowing the molten longitudinal seal 42 open and/or creating undesirable stresses that weaken the longitudinal seal 42. FIGS. 15-17 illustrate one example of a pinching member 80 that is an elongated, blade-like member that extends from a slot 82 in one of the insulating blocks 78. The pinching member extends from one insulating block 78 to the other. The pinching member 80 is held in the slot 82 by a pair of pins 86 that extend through clearance holes 88 (FIG. 16). The clearance around the pins 86 allows the required movement of the pinching member into and out of the insulating block. The pinching member 80 is biased from the insulating block 78 by a biasing member 90. The illustrated biasing member is an elongated spring that includes a number of bends 92. The biasing member is constrained between the slot 82 and the pinching member 80. An end 94 (FIG. 16) of the biasing member 90 is constrained in a hole 96 (FIG. 17). Referring to FIG. 17, the illustrated pinching member 80 is positioned adjacent to the heating wire 76.

Figure 23:
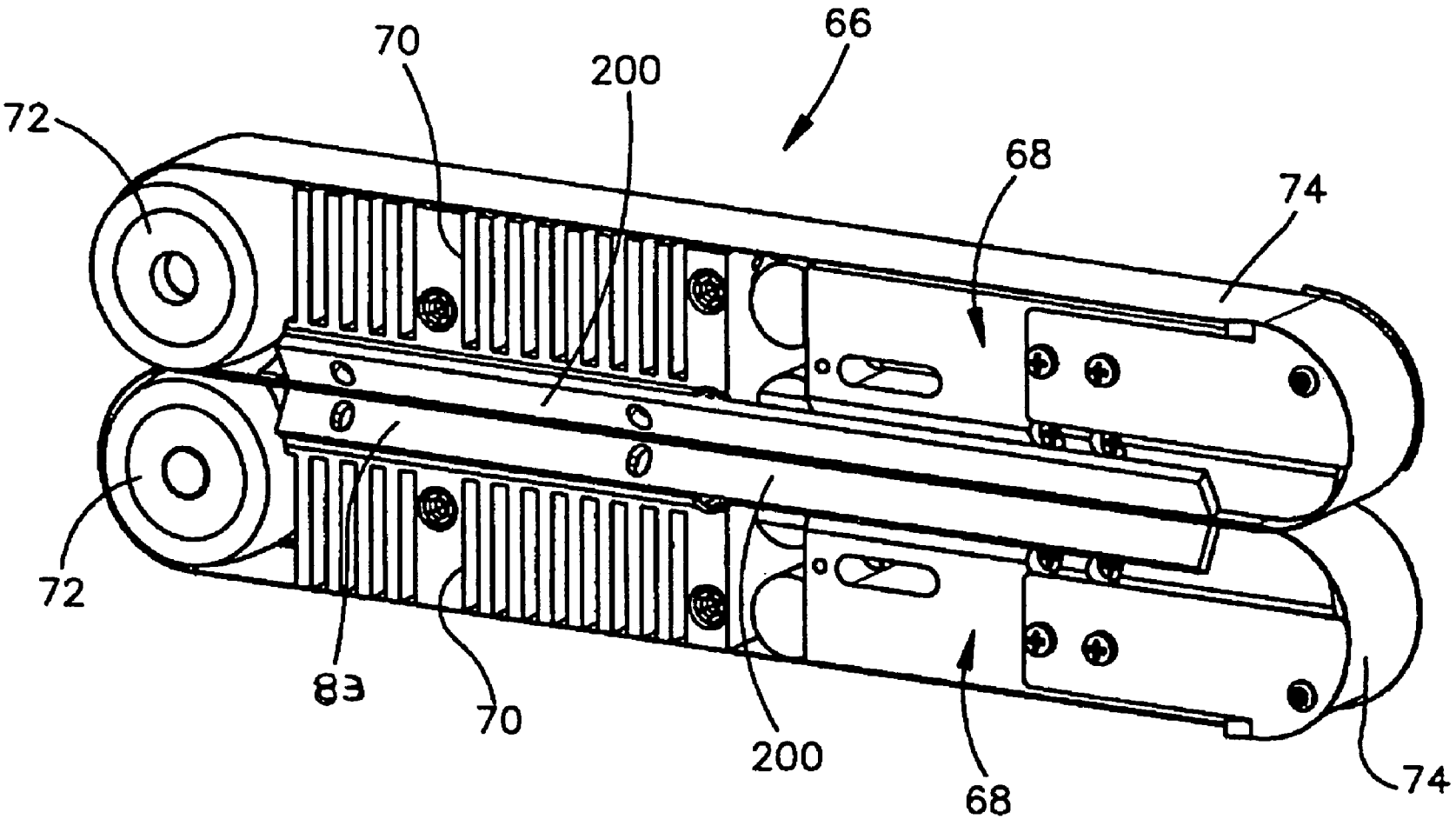
FIG. 23 is a perspective view of a sealing assembly of a machine for converting a web of pouches to fluid filled units.

FIG. 23 illustrates an example of a cover 83 that extends along the length of the sealing elements 68 and the cooling elements. The cover 83 of this example spans a gap between the sealing elements 68 and the cooling elements 70. The cover 83 illustrated by FIG. 23 comprises a pair of elongated bars 200. One or both of the elongated bars 200 may be coupled to a biasing member, such as a spring. The length of the cover 83 may be selected to correspond to the length along the sealing assembly 66 where the plastic that forms the seal is molten. In the example illustrated by FIG. 23, the elongated bars extend along substantially the entire length of the sealing elements and the cooling elements 70.

FIG. 17 illustrates an embodiment where the elongated heating wire 76 is positioned on the insulating block 78 such that the heating wire 76 is at an angle θ with respect to the path of travel T. In the illustrated embodiment, angle θ is approximately 1.5 degrees. As is illustrated in FIG. 17, positioning the heating wire 76 at an angle creates a seal 42 that is significantly wider than the heating wire. The increased width may add to the strength of the seal.

In an exemplary embodiment, the machine 50 can operate in two modes, an idle mode and a production mode. In the example illustrated by FIG. 13, the machine 50 includes a controller 98, an idle control interface 100, and a production control interface 102. In various embodiments of the invention the machine 50 performs differently in idle mode than in production mode. For example, the drive may advance the web 10 when the machine 50 is in production mode while holding the web 10 stationary when in idle mode. The machine 50 is normally placed into idle mode by the machine operator, by actuating an idle control interface 100 such as a switch, so that the operator may take a short break or when one machine operator takes over for another machine operator. Once the operator returns or the new operator is ready, the machine 50 is placed into production mode by the machine operator actuating a production control interface 102 (also referred to herein as a start control interface), such as a switch. The idle control interface 100 and production control interface 102 can be any apparatus or method of initiating or actuating idle and production modes, such as levers, pedals, buttons, software assisted touch screens, switches etc. Three examples of machine function that may be different in production mode than idle mode are the drive moving the web 10 along the path of travel, the blower 62 filling a pouch 12, and the sealing elements 68 providing heat to create a seal. The controller 98 applies a control algorithm to control elements of the machine 50, such as the drive rollers 72, the blower 62, and the sealing elements 68, based on the selected mode (idle or production) and the amount of time the machine 50 has been in the selected mode. Other functions may differ between idle and production mode as well.

Figure 19:
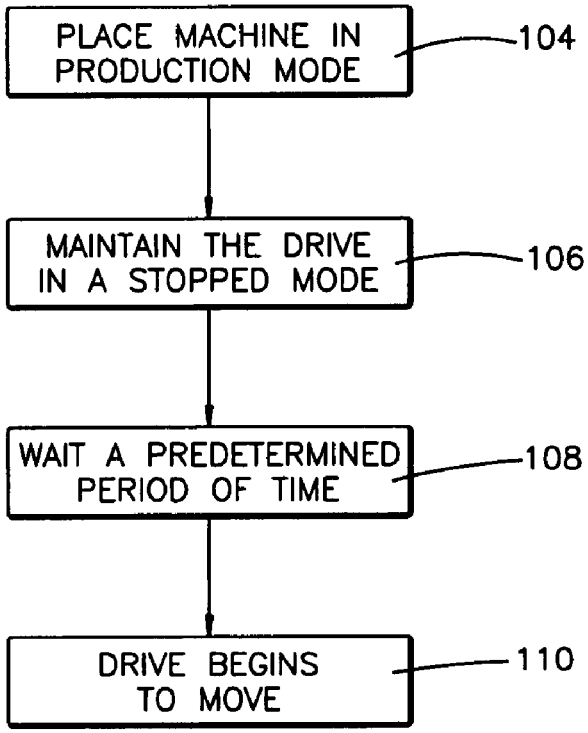
FIG. 19 is a flow chart that illustrates a method for converting a web pouches to fluid filled units.

The controller 98 may, for example, be programmed to control the machine components to accommodate the following situations. During typical production, the sealing elements 68 are set to a predetermined temperature that will seal a pouch 12 as the web 10 passes by the sealing elements 68. When the machine 50 is in idle mode and the drive holds the web 10 stationary, the web material may be exposed to the sealing elements 68 for a prolonged period of time. If the sealing elements 68 are maintained at their production temperature, the web material may be damaged by the heat. Therefore, the sealing elements 68 are normally deactivated when the machine 50 is placed into idle mode. Upon actuation of production mode, the sealing elements 68 are activated and the sealing elements 68 begins to heat, reaching an appropriate production temperature over a period of time. If the drive is immediately initiated when production mode begins, a pouch 12 or number of pouches may pass by the sealing elements 68 before the sealing elements 68 have reached production temperature. The seals 42 produced by sealing elements 68 that are below normal production temperature may not be as strong as seals 42 produced by sealing elements 68 at normal production temperatures. As illustrated in FIG. 19, to adjust for the period of time in which it takes for the sealing elements 68 to reach production temperature, the drive may be maintained in a stopped mode 106 for a predetermined amount of time 108 after the operator places the machine 50 in production mode 104. This allows the heating elements 68 to reach an appropriate production temperature before the drive begins to move the web along the path of travel.

Figure 20:
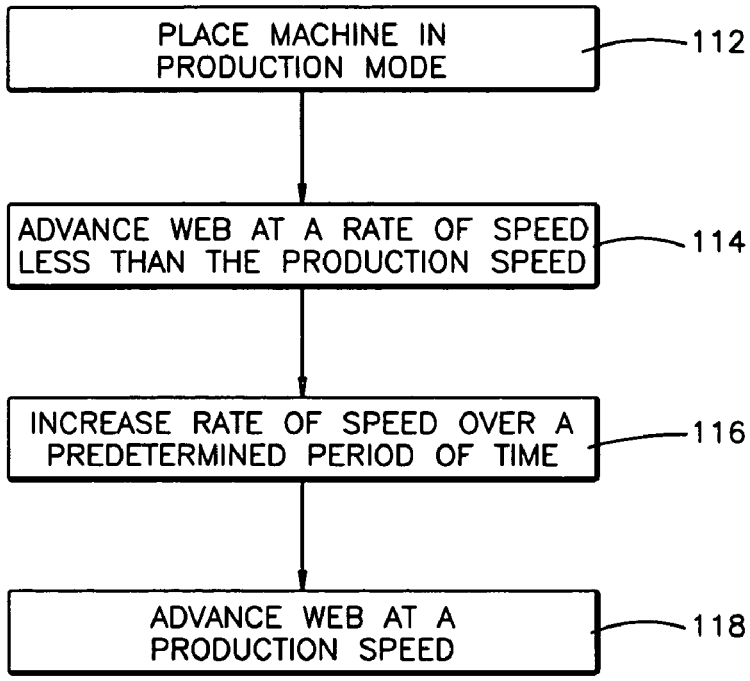
FIG. 20 is a flow chart that illustrates a method for converting a web pouches to fluid filled units.

Alternatively, as illustrated in FIG. 20, the drive may begin to move the web 10 upon actuation of production mode 112, but may begin moving 114 the web 10 at a speed that is less than the drive's normal production speed. The drive speed can be ramped up 116 over a period of time until it reaches normal production speed 118. The ramp up of the drive speed can be synchronized with the ramp up of seal element 68 temperature to insure that seals enclosing pouches 12 have appropriate integrity and strength.

The blower 62 may be controlled to perform differently in production and idle modes. During production mode, the blower 62 operates at a predetermined fill flow rate. The fill flow rate is determined by two factors. The first factor is the amount of air, or other fluid, needed to pass through the blower 62 and into a pouch 12 to fill the pouch 12. The second factor is the time period over which the pouch 12 receives air from the blower 62. The time the pouch 12 receives air from the blower 62 is determined by the speed of the drive. The faster the drive moves the web 10 along the path of travel T, the higher the fill flow rate needs to be to fully inflate or fill the pouch 12. In one embodiment the blower 62 may be stopped when the machine 50 is in idle mode and may operate at the predetermined fill flow rate when the machine 50 is in production mode. However, if the machine 50 is placed in idle mode while a portion of the pouch 12 has already passed the blower 62, that pouch 12, upon initiation of production mode, may not be fully inflated upon sealing. This may be due to air already blown into the pouch 12 before the machine 50 was placed in idle mode, leaking out of the non-sealed portion of the inflation edge 18 as the machine 50 remains idle.

Figure 21:
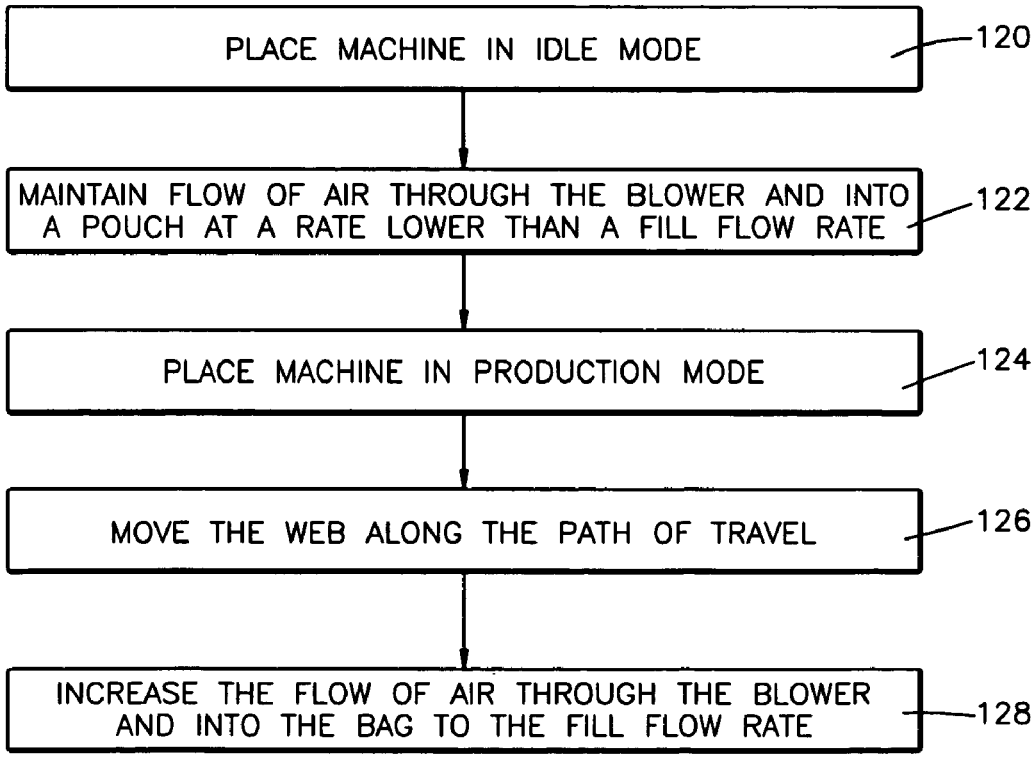
FIG. 21 is a flow chart that illustrates a method for converting a web pouches to fluid filled units.

To account for this, as illustrated by FIG. 21, when the machine is placed 120 in idle mode, flow from the blower 62 and into the pouch 12 may be maintained 122 while the machine 50 is in idle mode. The flow rate during the idle mode is less than the fill flow rate 122 during production mode. This idle flow rate would be selected to maintain the amount of air present in the pouch 12 when the machine 50 was placed into idle mode. Once the machine is placed 124 in production mode and the drive moves 126 the web along the path of travel T, the blower 62 returns 128 to the normal production fill flow rate.

Figure 22:
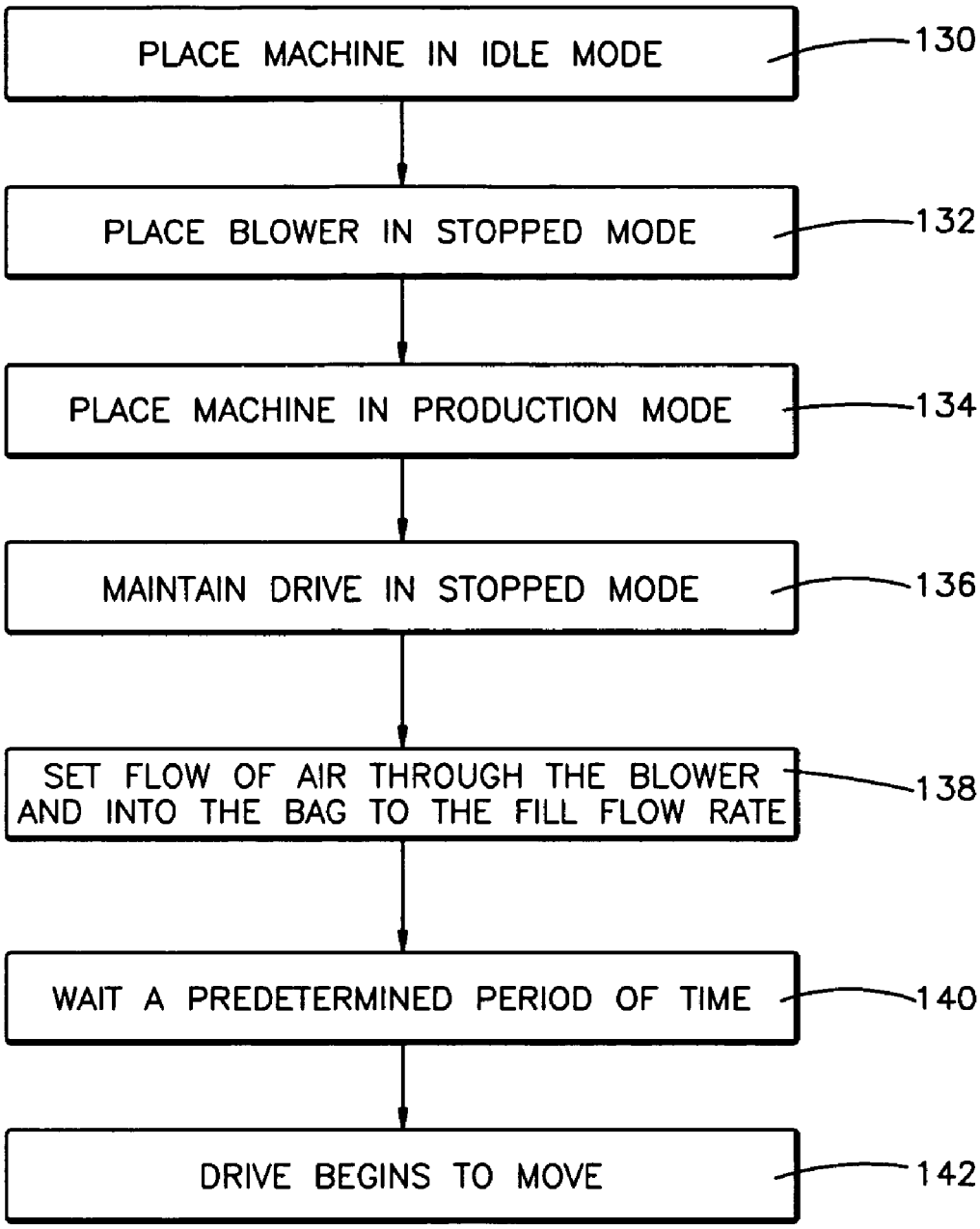
FIG. 22 is a flow chart that illustrates a method for converting a web pouches to fluid filled units.

Alternatively, as illustrated in FIG. 22, when the machine is placed 130 in idle mode, the blower 62 may be stopped 132 or significantly slowed. When the machine 142 is placed 134 in production mode, the drive is maintained in a stopped or significantly slowed state for a predetermined period of time 140 after the machine 50 is placed in production mode 134 (as described above) and the blower 62 returns to the fill flow rate. This arrangement will allow the pouch 12 to fill with an appropriate amount of air prior to the drive moving the web 142 along the path of travel T.

On occasion, the machine 50 can be placed into idle mode while one portion of the pouch 12 is engaged with the blower 62 (station B of FIGS. 8A and 8B) and another portion of the pouch 12 is engaged with the guide rollers 54. In this arrangement, if the pouch 12 continues to fill at its fill flow rate when the machine is in idle mode, the portion of the pouch 12 engaged with the guide rollers 54 may begin to inflate. This may cause the web 10 to bind in the guide rollers 54 and hamper the web's movement upon the machine 50 being placed into production mode. The idle flow rate may be set such as to maintain a proper amount of air in the pouch 12 during idle mode and not to cause inflation of the portion of the pouch 12 engaged with the guide rollers 54. This idle flow rate would be a rate lower than the fill flow rate. The web 10 is normally held taught between the drive and the closest roller. This creates a barrier where the web 10 intersects the closest roller over which movement of air can be restricted. The idle flow rate is selected to be high enough to maintain a proper amount of air in the pouch 12 and low enough not to overcome the barrier created by the engagement of the web 10 with the last roller.

An example of an application in which a machine 50 operates in idle and production modes is when a web of long pouches 12 is used. For example, if twelve inch pouches 12 are used it is likely that upon initiation of idle mode, one portion of the pouch 12 will be in engagement with the sealing elements 68, while another portion of the pouch 12 will be positioned for filling by the blower 62. On occasion, one portion of the pouch 12 may remain in the guide rollers 54, while other portions are engaged with the sealing elements 68 and the blower 62. It is useful to use machines and methods described above that can be operated in an idle mode and a production mode to insure that the seal has integrity, that the pouch 12 is properly filled, and that the web 10 does not bind in the guide rollers 54 due to over inflation.

The present invention is not to be considered limited to the precise construction disclosed. Various modifications, adaptations and uses may occur to those skilled in the art to which the invention relates. All such modifications, adaptations, and uses fall within the scope or spirit of the claims.

The invention claimed is:

1. A machine for converting a web of preformed pouches to dunnage units, wherein the web includes a continuously closed inflation edge that extends along an entire length of the web and a continuously closed remote edge that extends along the entire length of the web, wherein an entire width of the web is defined between the inflation edge and the remote edge, the pouches being defined by transverse seals that extend from a the remote edge of the web to within a predetermined distance of an the inflation edge of the web, the machine comprising:

a) a guide pin for insertion between the transverse seals and the inflation edge of the web to define a path of travel of the web;

b) a drive for moving web along the path of travel;

c) a separation member positioned offset from the inflation edge of the web, the separation member configured to open a single layer of the web proximate to the closed inflation edge of the web, wherein the separation member is configured to open the web at a location on the web positioned prior to a point of inflation and prior to a point of sealing of the preformed pouches with respect to the path of travel;

d) a blower positioned with respect to the path of travel for inflating the preformed pouches; and e) an elongated sealing element being positioned to provide a longitudinal seal that intersects the transverse seals to close the preformed pouches and form inflated dunnage units.

2. The machine of claim 1 wherein the elongated sealing element is oriented at approximately 1.5 degrees with respect to the path of travel.

3. The machine of claim 1 wherein the separation member includes a cutting surface.

4. The machine of claim 1 wherein the web includes a line of perforations and the separating member includes a blunt surface positioned to engage the web at the line of perforations.

5. A machine for converting a web of preformed pouches to dunnage units, wherein the web includes a continuously closed inflation edge that extends along an entire length of the web and a continuously closed remote edge that extends along the entire length of the web, wherein an entire width of the web is defined between the inflation edge and the remote edge, the pouches being defined by transverse seals that extend from a the remote edge of the web to within a predetermined distance of an the inflation edge of the web, the machine comprising a) a guide pin for insertion between the transverse seals and the inflation edge of the web to define a path of travel of the web wherein the guide pin includes an opening for inflating the web;

b) a drive for moving web along the path of travel; and c) a cutter positioned offset from the inflation edge of the web, the cutter configured to open a single layer of the web proximate to the closed inflation edge of the web for inflation, wherein the cutter is configured to open the web at a location on the web positioned prior to a point of inflation and prior to a point of sealing of the preformed pouches with respect to the path of travel.

6. A machine for converting a web of preformed pouches to dunnage units, wherein the web includes a continuously closed inflation edge that extends along an entire length of the web and a continuously closed remote edge that extends along the entire length of the web, wherein an entire width of the web is defined between the inflation edge and the remote edge, the pouches being defined by transverse seals that extend from a the remote edge of the web to within a predetermined distance of an the inflation edge of the web; the machine being operable in a production mode and in an idle mode and comprising:

a) a guide pin for insertion between the transverse seals and the inflation edge of the web to define a path of travel of the web wherein the guide pin includes an opening for inflating the web;

b) a drive for moving web along the path of travel;

c) a separating means positioned offset from the inflation edge of the web for opening a single layer of the web proximate to the closed inflation edge of the web for inflation;

d) a heating element positioned to provide a longitudinal seal that intersects the transverse seals to close the preformed pouches and form inflated dunnage units.

7. The machine of claim 6 wherein the separating means is configured to open the web at a location on the web positioned prior to a point of inflation and prior to a point of sealing of the preformed pouches with respect to the path of travel.

8. A machine for converting a web of preformed pouches to dunnage units, wherein the web includes a continuously closed inflation edge that extends along an entire length of the web and a continuously closed remote edge that extends along the entire length of the web, wherein an entire width of the web is defined between the inflation edge and the remote edge, the pouches being defined by transverse seals that extend from a the remote edge of the web to within a predetermined distance of an the inflation edge of the web, the machine comprising:

a) a guide pin for insertion between the transverse seals and the inflation edge of the web to define a path of travel of the web;

b) a drive for moving web along the path of travel;

c) a separation member positioned offset from the inflation edge of the web, the separation member configured to open a single layer of the web proximate to the closed inflation edge of the web for inflation, wherein the separation member is configured to open the web at a location on the web positioned prior to a point of inflation and prior to a point of sealing of the preformed pouches with respect to the path of travel;

d) a blower positioned with respect to the path of travel for inflating the preformed pouches; and e) an assembly of a block and, a sealing element, wherein the sealing element is positioned to provide a longitudinal seal that intersects the transverse seals to close the preformed pouches and form inflated dunnage units.

9. The machine of claim 8 further comprising a cooling element and wherein the sealing element extends along substantially an entire length of a region where the longitudinal seal is molten.

* * * * *